US011707903B2

(12) United States Patent
Cappeller et al.

(10) Patent No.: US 11,707,903 B2
(45) Date of Patent: Jul. 25, 2023

(54) APPARATUS FOR THE CONTROLLED RETURN OF THE STEMS IN CYLINDERS APPLIED TO STAMPING PRESSES

(71) Applicant: SPECIAL SPRINGS S.R.L., Romano D'Ezzelino (IT)

(72) Inventors: Dante Cappeller, Cartigliano (IT); Massimo Fiorese, Bassano Del Grappa (IT); Francesco Bordin, Caerano di San Marco (IT)

(73) Assignee: SPECIAL SPRINGS S.R.L., Romano d'Ezzelino (IT)

( * ) Notice: Subject to any disclaimer, the term of this patent is extended or adjusted under 35 U.S.C. 154(b) by 185 days.

(21) Appl. No.: 17/166,098

(22) Filed: Feb. 3, 2021

(65) Prior Publication Data

US 2021/0245468 A1 Aug. 12, 2021

(30) Foreign Application Priority Data

Feb. 6, 2020 (IT) ..... 102020000002302

(51) Int. Cl.
*B30B 15/18* (2006.01)
*B21D 24/14* (2006.01)
(Continued)

(52) U.S. Cl.
CPC ..... *B30B 15/186* (2013.01); *B21D 24/14* (2013.01); *B30B 1/32* (2013.01); *B30B 15/163* (2013.01);
(Continued)

(58) Field of Classification Search
CPC ..... B60B 15/163; B60B 15/186
See application file for complete search history.

(56) References Cited

U.S. PATENT DOCUMENTS 9,808,849 B2 * 11/2017 Kohno ..... B21D 24/08
10,286,438 B2 * 5/2019 Kohno ..... B21D 24/02
(Continued)

FOREIGN PATENT DOCUMENTS

CN 203044619 U 7/2013
DE 4003016 A1 8/1991
(Continued)

OTHER PUBLICATIONS

European Extended Search Report dated Jun. 25, 2021 received in European Patent Application No. 21 15 4423.4.
(Continued)

*Primary Examiner* — Thomas E Lazo
(74) *Attorney, Agent, or Firm* — Scully, Scott, Murphy & Presser, P.C.

(57) ABSTRACT

An apparatus for the controlled return of the stems in cylinders of the types that can be applied to a press for stamping sheet metal, comprising:

at least one fluid-operated cylinder), at least one hydraulic accumulator which is fluidically connected to the at least one cylinder by means of a hydraulic circuit which comprises:

a duct for the discharge of the working fluid from the at least one cylinder and a duct/branch for the intake of the working fluid in the hydraulic accumulator, a duct for loading the working fluid in the at least one cylinder and at duct/branch for the output of the working fluid from the hydraulic accumulator.

10 Claims, 6 Drawing Sheets

(51) Int. Cl.

| | |
|---|---|
| ***B30B 1/32*** | (2006.01) |
| ***B30B 15/16*** | (2006.01) |
| ***F15B 1/02*** | (2006.01) |
| ***F15B 21/14*** | (2006.01) |

(52) U.S. Cl.
CPC ..... *B30B 15/165* (2013.01); *F15B 1/021* (2013.01); *F15B 21/14* (2013.01)

(56) References Cited

U.S. PATENT DOCUMENTS

| | | | | |
|---|---|---|---|---|
| 2006/0101891 | A1 | 5/2006 | Shin et al. | |
| 2006/0260379 | A1* | 11/2006 | Cappeller | B21D 24/08 72/350 |
| 2015/0360274 | A1* | 12/2015 | Kohno | B21D 24/14 72/453.13 |
| 2018/0243811 | A1* | 8/2018 | Kohno | B30B 15/16 |

FOREIGN PATENT DOCUMENTS

| | | | |
|---|---|---|---|
| EP | 3115119 | A1 | 1/2017 |
| EP | 3175936 | A1 | 6/2017 |
| FR | 2 514 692 | A1 | 4/1983 |
| FR | 2667257 | A1 | 4/1992 |

OTHER PUBLICATIONS

Italian Search Report and Written Opinion dated Oct. 23, 2020 issued in IT 202000002302, with partial translation.

* cited by examiner

APPARATUS FOR THE CONTROLLED RETURN OF THE STEMS IN CYLINDERS APPLIED TO STAMPING PRESSES

The present invention relates to an apparatus for the controlled return of the stems in cylinders applied to stamping presses.

Currently, in presses for stamping sheet metal, equipment is used in order to lock the sheet metal to be shaped during the deformation steps.

The sheet metal, in fact, must be locked in multiple points proximate to one or more perimetric edges in order to prevent that perimetric regions from moving in an inappropriate manner between the portions of the die, with respect to the region to be deformed, jeopardizing the desired shaping result.

The equipment currently known comprises usually at least one fluid-operated (gas- and/or oil-operated) actuator for the translational motion of a first sheet presser element, which is adapted to support the sheet metal, during an initial step of a shaping operation.

Such fluid-operated actuator is normally a fluid-operated cylinder.

A first sheet presser element, which is the lower one in the configuration for use, supports the sheet metal so that the sheet metal is located above a first lower die part which is integral with the footing of the press.

Such first sheet presser element is adapted to cooperate with a second sheet presser element, which is instead integral with a second die part, associated with the upper slider of the press.

During the shaping operation, i.e., during the descent of the upper slider of the press, the two sheet presser elements keep a perimetric portion of the sheet metal closed between them.

The fluid-operated cylinders that support the lower sheet presser element are part of an apparatus which also comprises a circuit for supplying the working fluid, i.e., gas or oil.

Such apparatus is provided with adapted means for the delayed return of the stems of said cylinders during the opening step of the press.

When the stem of the cylinder is pushed downward by the action of the press, the fluid, which is inherently compressible, is expelled only partially from the pressurized chamber of the cylinder.

In fact, at the beginning of the step for the extraction of the sheet metal shaped by the press, when the upper slider moves upward again and the cylinders are discharged, the compressed fluid, which is still present inside the chamber of each cylinder, expands, acting with a substantially impulsive thrust on the perimetric portions of the sheet metal.

This can cause warping, inflections and other similar deformations, or even push the entire sheet metal to strike the upper die part, causing irreparable damage.

The means for the delayed return of the stems of the cylinders comprise a hydraulic controller adapted to receive the pressurized oil, which is moved in the discharge ducts under the thrust of the upper slider of the press.

Simply applying a hydraulic accumulator is not enough to eliminate the so-called "spring back" effect of the stem due to the expansion of the compressed fluid that remains in the cylinder at the end of its compression.

In fact, it is necessary to coordinate the operation of the hydraulic plenum chamber (or of the hydraulic plenum chambers) and of the press so as to advance the halting of the injection of oil into the cylinder and avoid even the slightest return of oil into the accumulator if the thrust of the fluid occurs simultaneously with or, worse still, precedes the closure of the one-way valve.

The aim of the present invention is to provide an apparatus for the controlled return of the stems in cylinders applied to stamping presses that is capable of improving the background art in one or more of the aspects indicated above.

Within this aim, an object of the invention is to provide an apparatus for the controlled return of the stems in cylinders applied to stamping presses that avoids the "spring back" effect or in any case reduces it with respect to similar apparatuses of a known type.

Another object of the invention is to provide an apparatus for the controlled return of the stems in cylinders applied to stamping presses that can be applied easily to known and already-operating presses.

Another object of the invention is to provide an apparatus for the controlled return of the stems in cylinders applied to stamping presses in which the force applied by the gas cylinder actuators to the lower sheet presser element can be adjusted.

Moreover, an object of the present invention is to overcome the drawbacks of the background art in a manner that is alternative to any existing solutions.

Another object of the invention is to provide an apparatus for the controlled return of the stems in cylinders applied to stamping presses that is highly reliable, relatively easy to provide and at competitive costs.

This aim and these and other objects which will become better apparent hereinafter are achieved by an apparatus for the controlled return of the stems in cylinders of the types that can be applied to a press for stamping sheet metal, for the translation of a first sheet presser element, said first sheet presser element being in contact with said stems and being proximate to a first die part, said first sheet presser element cooperating with a second sheet presser element which is integral with a slider of said press, said slider supporting a second die part which is complementary to said first die part, said apparatus being characterized in that it comprises:

at least one fluid-operated cylinder, at least one hydraulic accumulator which is fluidically connected to said at least one cylinder by means of a hydraulic circuit which comprises:

a duct for the discharge of the working fluid from said at least one cylinder and a duct/branch for the intake of the working fluid in said hydraulic accumulator, a duct for loading said working fluid in said at least one cylinder and a duct/branch for the output of said working fluid from said hydraulic accumulator, said apparatus comprising, between said discharge duct and said intake duct/branch, at least two branches of said hydraulic circuit:

a first branch, for the discharge of said working fluid during the translation of said slider towards the bottom dead center, a second branch, for the discharge of the overpressure of said residual working fluid within said at least one cylinder, once said slider has reached the bottom dead center.

Further characteristics and advantages of the invention will become better apparent from the description of a preferred but not exclusive embodiment of the apparatus for the controlled return of the stems in cylinders applied to stamping presses according to the invention, illustrated by way of non-limiting example in the accompanying drawings, wherein.

Figure 1:
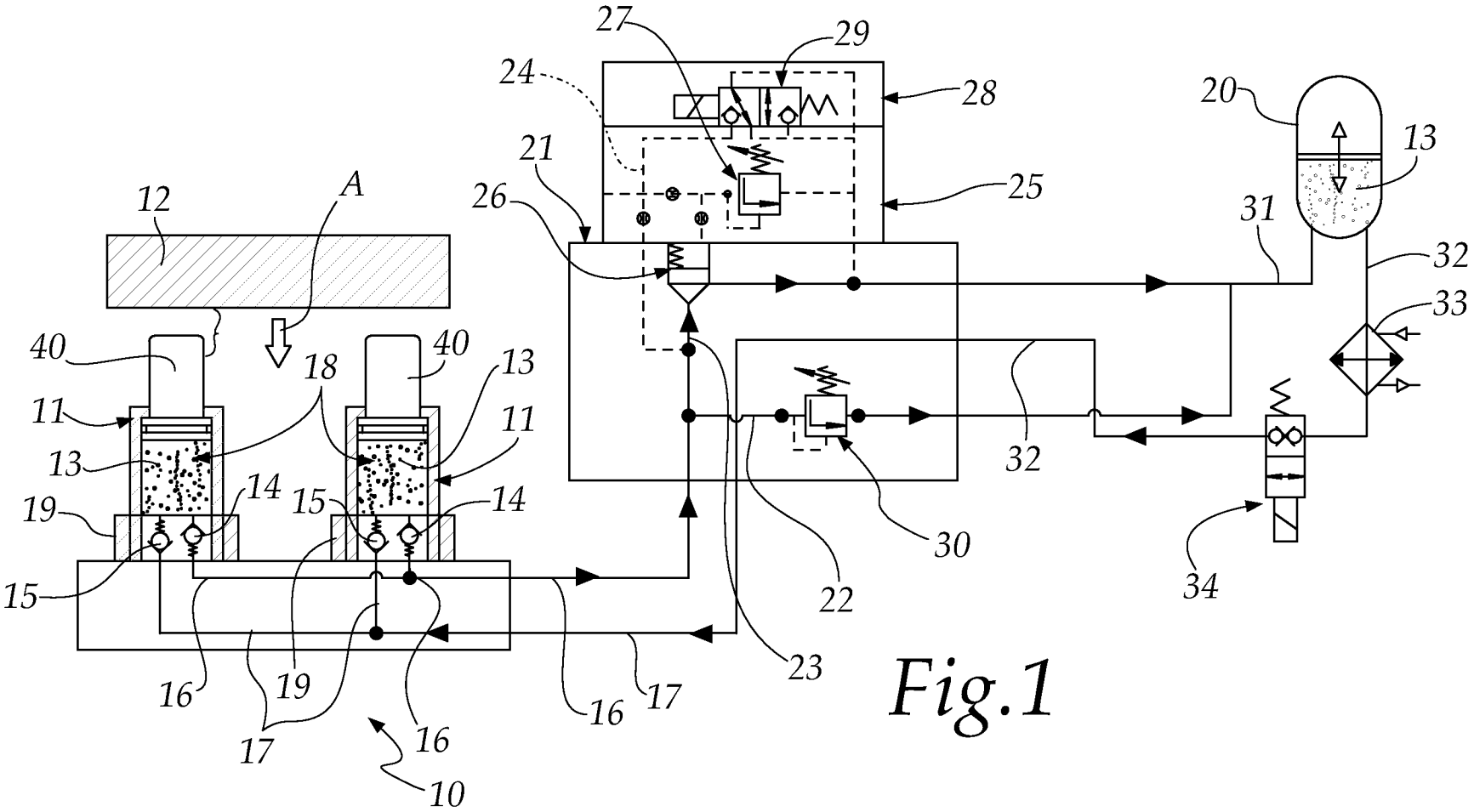
FIG. 1 is a simplified schematic view of an apparatus for the controlled return of the stems in cylinders applied to stamping presses, according to the invention.

With reference to the figures, an apparatus for the controlled return of the stems in cylinders applied to stamping presses, according to the invention, is generally designated by the reference numeral 10.

Such apparatus comprises at least one fluid-operated cylinder 11 provided with a stem 40.

In the example shown in the figures, there are two cylinders 11.

The cylinders 11 are used in a press 50 for stamping sheet metal 51, for the vertical translational motion of a first lower sheet presser element 52, in contact with the stems 40 and proximate to a first lower die part 53.

The first sheet presser element 52 cooperates with a second upper sheet presser element 54 which is integral with a slider 12 of the press 50, which supports a second upper die part 55, which is complementary to the first die part 53.

The apparatus 10 is constituted by a plurality of elements connected in a circuit, with circulating working fluid constituted by oil 13, or the like.

In particular, each cylinder 11 has, for example at its end plate 19:

- a first one-way valve 14 affecting a duct 16 for the discharge of the working fluid from the chamber 18 of the cylinder 11,
- a second one-way valve 15 affecting a duct 17 for loading the working fluid in the chamber 18 of the cylinder 11.

The discharge duct 16 and loading duct 17 are fluidically connected to a hydraulic accumulator 20, such as for example a nitrogen-based hydraulic accumulator.

In particular, the discharge duct 16 splits into three branches of the hydraulic circuit of the apparatus 10, for example by means of a hydraulic manifold 21.

The three branches are:

- a first branch 23, for the discharge of the oil 13 during the translation of the slider 12 towards the bottom dead center,
- a second branch 24, for the discharge of the overpressure of the residual oil 13 within the chamber 18, once the slider 12 has reached the bottom dead center,
- a third safety branch 22.

The expression "bottom dead center", in the present description, is meant the lower stroke limit point of the slider 12.

The three hydraulic circuit branches 22, 23 and 24 are extended between the discharge duct 16 and the hydraulic accumulator 20.

The first branch 23 comprises means 25 for discharging the oil 13 from the chamber 18 of the cylinder 11.

The discharge means 25 comprise:

- a pressure limiting valve 26, for example a cartridge valve,
- an adjustable sequence valve 27, adapted to adjust the force contrasting the lowering of the stems 40 of the cylinders 11.

The second branch 24 comprises means 28 for releasing the pressure of the residual oil 13 in the chamber 18 of the cylinder 11 with the slider 12 at the bottom dead center.

The means 28 for releasing the pressure of the residual oil 13 comprise, in turn, a directional valve 29.

The third branch 22 comprises a safety valve 30 at a pressure on the order of 315 bar.

These three branches 22, 23 and 24 merge in a single duct/branch 31, for the oil 13, for intake into the hydraulic accumulator 20.

The apparatus 10 comprises furthermore a duct/branch 32, for the oil 13, for output from the accumulator 20.

The apparatus 10 comprises, starting from the accumulator 20, along the output duct/branch 32, in the following order:

- means 33 for cooling the oil 13, which are constituted by an air/oil radiator,
- means 34 for the rise of the stems of the cylinders 11, which are constituted by a control valve.

In particular, the cooling means 33 are adapted to cool the oil 13.

One or more loading ducts 17 extend from said output duct/branch 32, downstream of the means 34 for the rise of the stems 40 of the cylinders 11.

The operation of the apparatus 10, according to the invention, is as follows.

FIG. 1 shows the apparatus 10 in an inactive condition before the slider 12 is lowered, in the direction of the arrow A.

Figure 2:
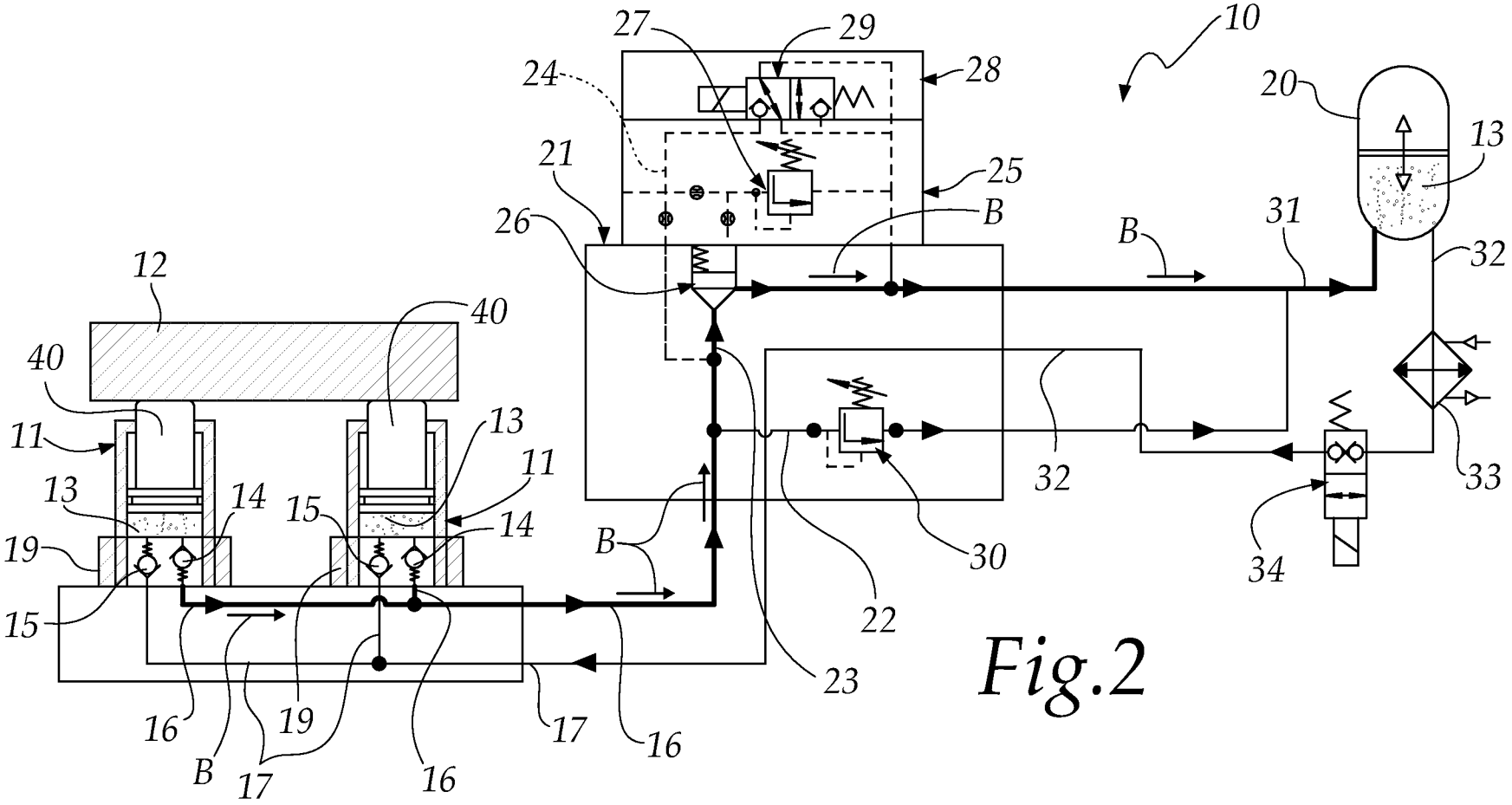
FIG. 2 is a schematic view of the apparatus of FIG. 1 in a first operating step.

While the slider 12 descends, in the direction of the bottom dead center (FIG. 2), the stems 40 are lowered and the oil 13, which is present in the chambers 18 of the cylinders 11, exits through the discharge ducts 16 and reaches the hydraulic accumulator 20 through the first branch 23 and the intake duct/branch 31, following the path indicated by the arrows B.

Figure 3:
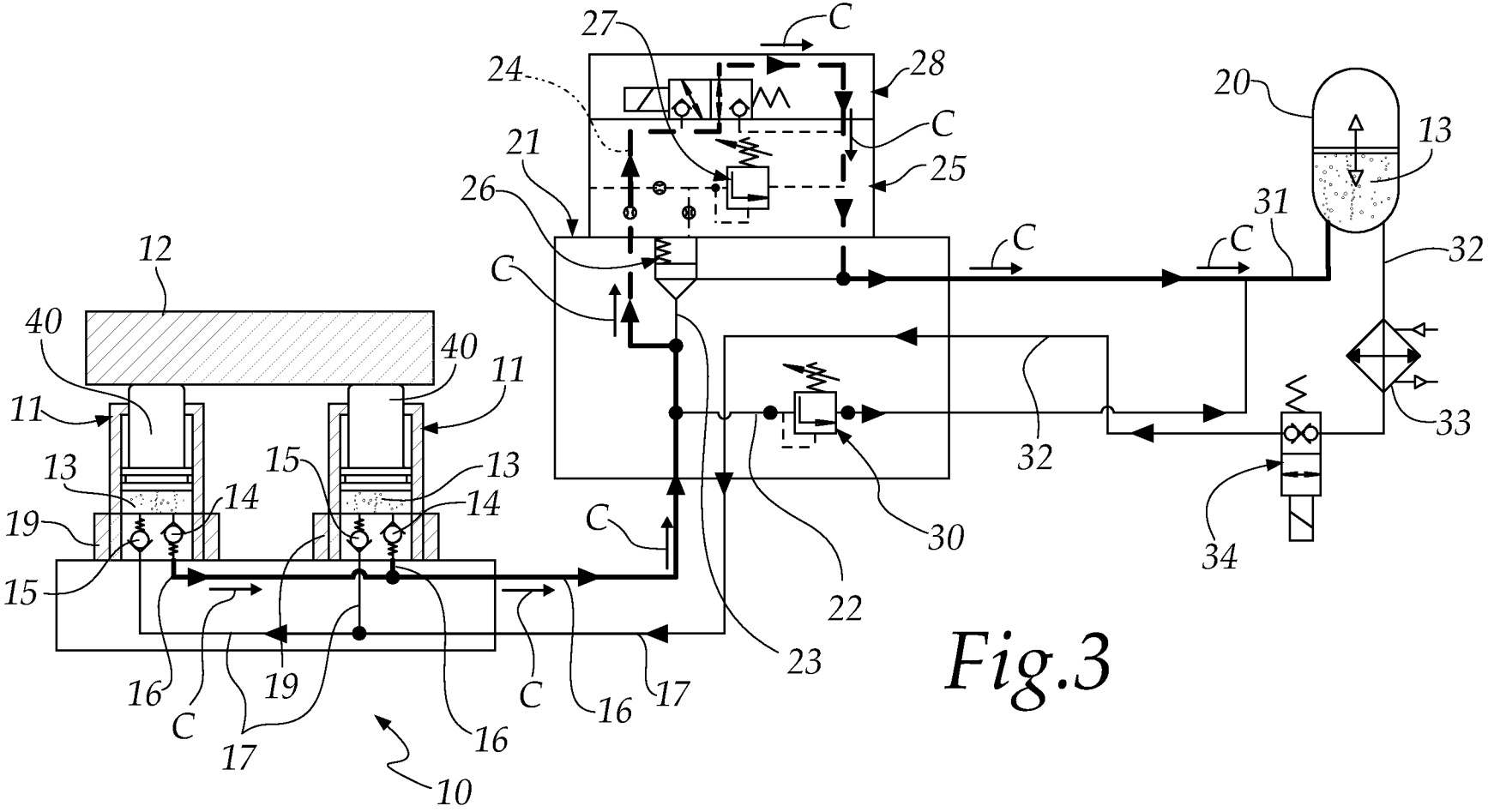
FIG. 3 is a schematic view of the apparatus of FIG. 1 in a second operating step.

Once the slider 12 has reached the bottom dead center (FIG. 3), any overpressure present inside the chambers 18 is reduced/eliminated, reducing/eliminating at the same time the "spring back" effect, actuating the means 28 for releasing the residual pressure, and thus directing the oil 13 that exits from the chamber 18 of the cylinders 11 toward the hydraulic accumulator 20, through the second branch 24 and the intake duct/branch 31, following the path indicated by the arrows C.

Figure 4:
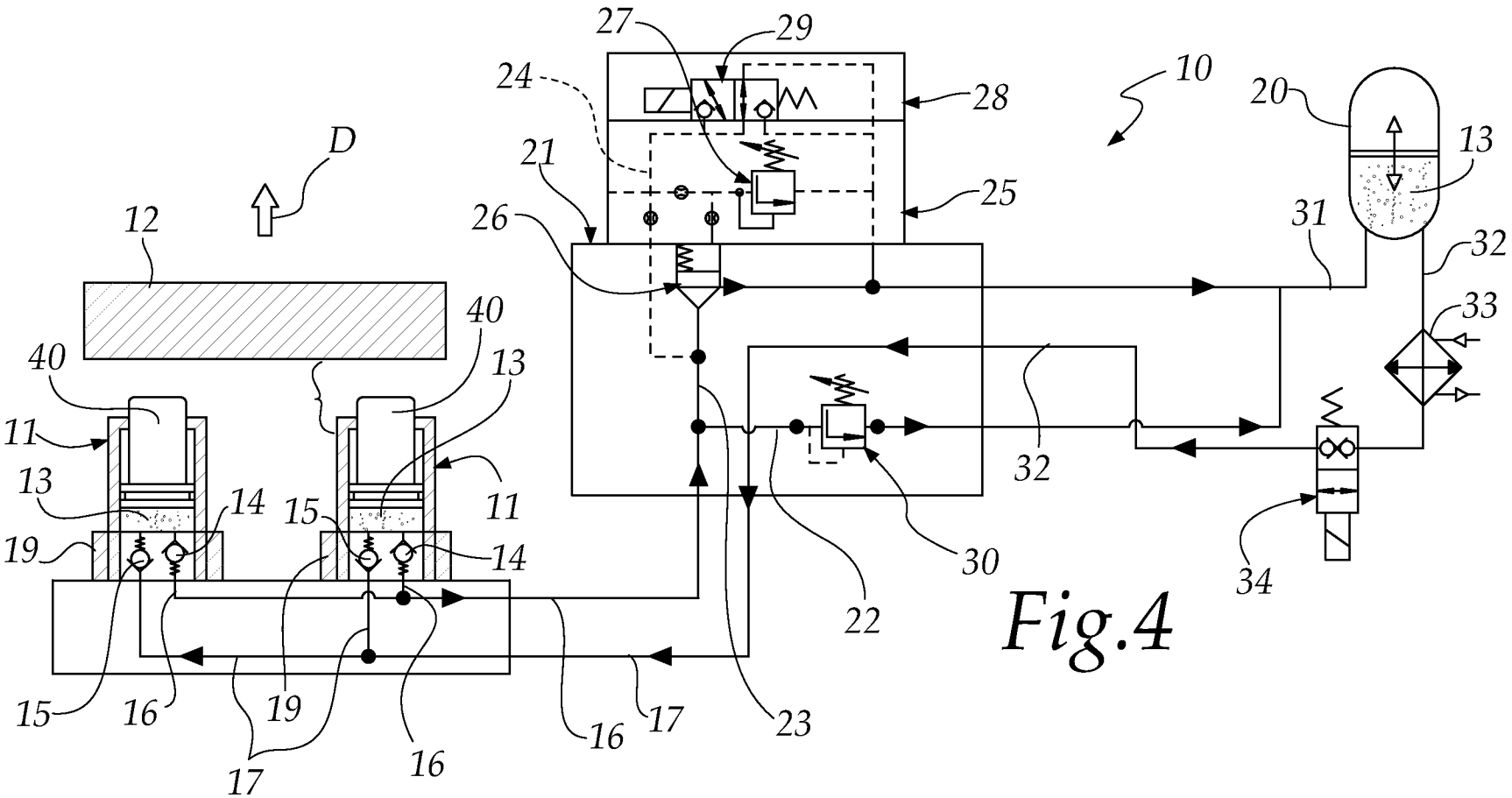
FIG. 4 is a schematic view of the apparatus of FIG. 1 in a third operating step.

When the slider 12 rises again, in the direction of the arrow D in FIG. 4, the stems 40 of the cylinders remain in the position that corresponds to that of the bottom dead center, having reduced/eliminated any overpressures present inside the chambers 18 of the cylinders 11.

Figure 5:
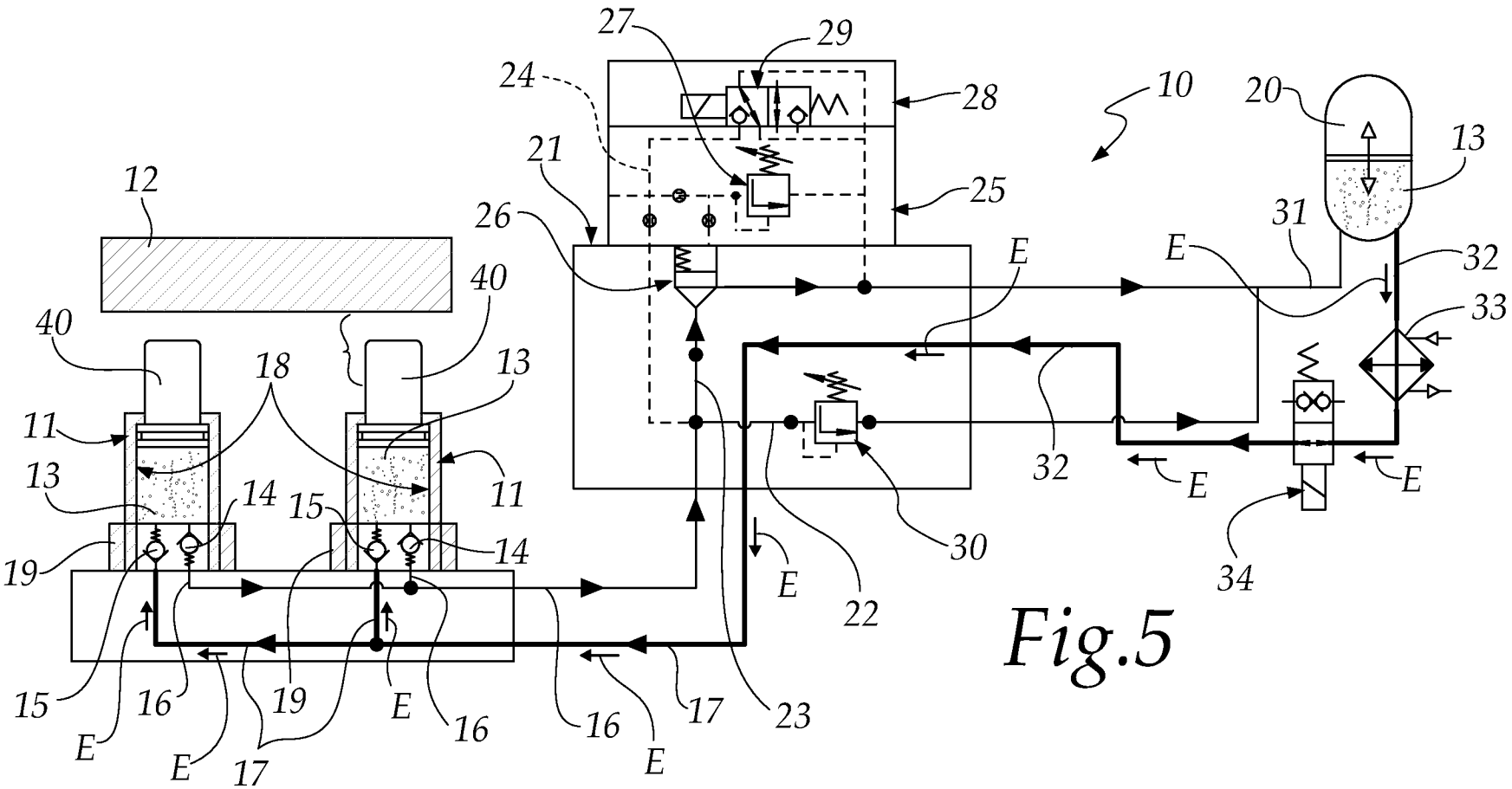
FIG. 5 is a schematic view of the apparatus of FIG. 1 in a fourth operating step.
Figure 6:
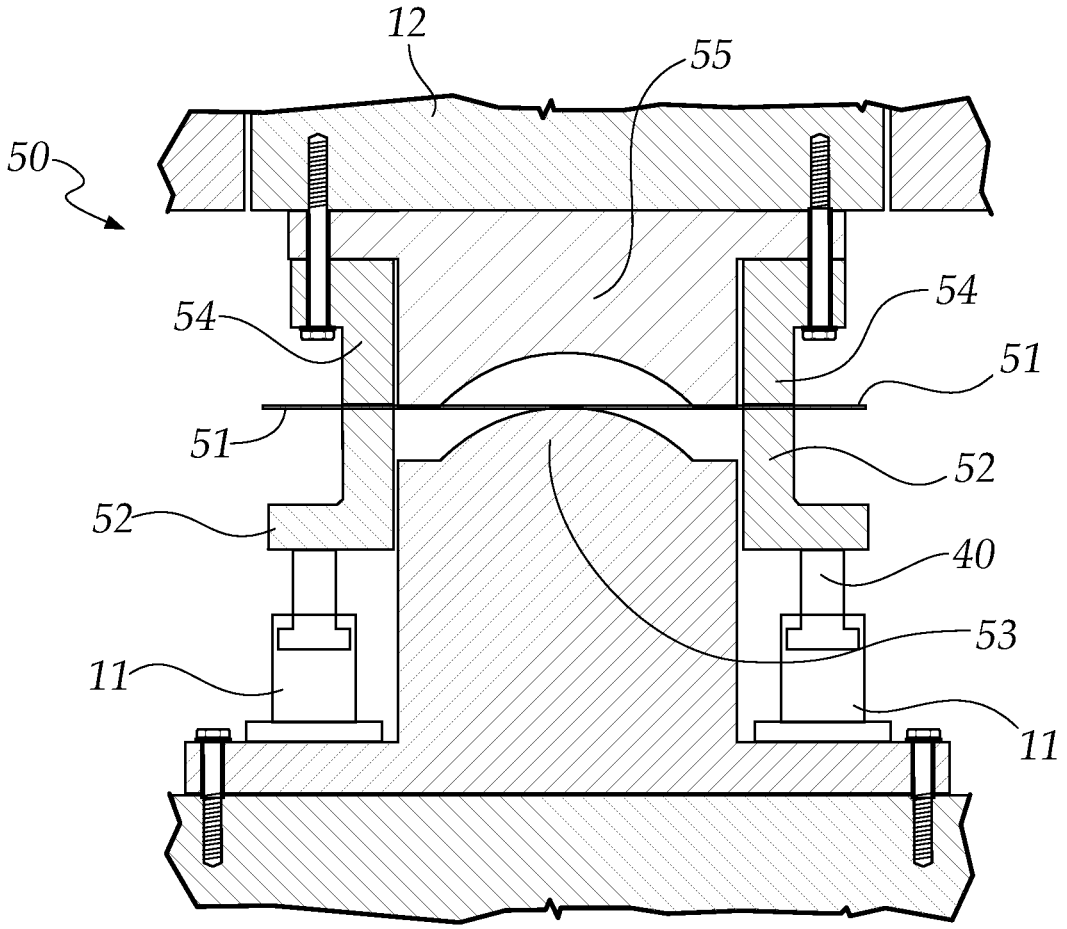
FIG. 6 is a sectional view of a press in which the apparatus of FIGS. 1 to 5 is applied.

When the slider 12 has returned to the initial position and/or the previously deformed sheet metal has been removed (FIG. 5), the stems 40 of the cylinders 11 are returned to the initial position, by actuating the means 34 for the rise of the stems and by directing the oil 13 from the hydraulic accumulator 20 to the chambers 18 of the cylinders, through the output duct/branch 32 and the loading ducts 17, following the path indicated by the arrows E.

In practice it has been found that the invention achieves the intended aim and objects, providing an apparatus for the controlled return of the stems in cylinders applied to stamping presses that avoids the "spring back" effect or in any case reduces it with respect to similar apparatuses of a known type.

The invention provides an apparatus for the controlled return of the stems in cylinders applied to stamping presses that can be applied easily to known and already-operating presses.

Moreover, the invention provides an apparatus for the controlled return of the stems in cylinders applied to stamping presses in which the force exerted by the gas cylinder actuators to the lower sheet presser element can be adjusted.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102020000002302 from which this application claims priority are incorporated herein by reference.

What is claimed is:

1. An apparatus for the controlled return of stems in cylinders of the types that can be applied to a press for stamping sheet metal, for a translation of a first sheet presser element, said first sheet presser element being in contact with said stems and being proximate to a first die part, said first sheet presser element cooperating with a second sheet presser element which is integral with a slider of said press, said slider supporting a second die part which is complementary to said first die part, said apparatus comprising:

at least one fluid-operated cylinder, at least one hydraulic accumulator which is fluidically connected to said at least one cylinder by means of a hydraulic circuit which comprises:

a duct for a discharge of a working fluid from said at least one cylinder and a duct/branch for an intake of the working fluid in said hydraulic accumulator, a duct for loading said working fluid in said at least one cylinder and a duct/branch for the output of said working fluid from said hydraulic accumulator, said apparatus comprising, between said discharge duct and said intake duct/branch, at least two branches of said hydraulic circuit:

a first branch, for the discharge of said working fluid during a translation of said slider towards a bottom dead center, a second branch, for the discharge of an overpressure of said residual working fluid within said at least one cylinder, once said slider has reached the bottom dead center; and wherein said at least one cylinder has:

a first one-way valve affecting said discharge duct, a second one-way valve affecting said loading duct.

2. The apparatus according to claim 1, wherein said first branch comprises means for discharging said working fluid from said at least one cylinder.

3. The apparatus according to claim 2, wherein said discharge means comprise:

a pressure limiting valve, an adjustable sequence valve.

4. The apparatus according to claim 1, wherein said second branch comprises means for releasing the pressure of said residual working fluid in said at least one cylinder with said slider at the bottom dead center.

5. The apparatus according to claim 4, wherein said means for releasing the pressure of said residual working fluid comprise a directional valve.

6. The apparatus according to claim 1, further comprising a third branch of said circuit which is parallel to said first branch and to said second branch, said third branch being a safety branch.

7. The apparatus according to claim 6, wherein said third branch comprises a safety valve.

8. The apparatus according to claim 1, further comprising, starting from said accumulator, along said output duct/branch, in the following order:

means for cooling said working fluid, means for a rise of said stem of said at least one cylinder.

9. The apparatus according to claim 8, wherein said means for the cooling of said working fluid are constituted by a radiator.

10. The apparatus according to claim 8, wherein said means for the rise of said stem of said at least one cylinder are constituted by a control valve.

* * * * *